US009694232B2

(12) United States Patent
Dixon

(10) Patent No.: US 9,694,232 B2
(45) Date of Patent: Jul. 4, 2017

(54) WORKOUT BENCH

(71) Applicant: Dana Kirk Dixon, Tucson, AZ (US)

(72) Inventor: Dana Kirk Dixon, Tucson, AZ (US)

( * ) Notice: Subject to any disclaimer, the term of this patent is extended or adjusted under 35 U.S.C. 154(b) by 0 days.

(21) Appl. No.: 14/685,354

(22) Filed: Apr. 13, 2015

(65) Prior Publication Data

US 2015/0290487 A1 Oct. 15, 2015

Related U.S. Application Data

(60) Provisional application No. 61/978,502, filed on Apr. 11, 2014.

(51) Int. Cl.

| | |
|---|---|
| ***A63B 21/078*** | (2006.01) |
| ***A63B 22/16*** | (2006.01) |
| ***A63B 22/18*** | (2006.01) |
| ***A63B 23/02*** | (2006.01) |

(Continued)

(52) U.S. Cl.

CPC ..... *A63B 21/078* (2013.01); *A63B 21/4029* (2015.10); *A63B 21/4035* (2015.10); *A63B 22/16* (2013.01); *A63B 22/18* (2013.01); *A63B 23/0233* (2013.01); *A63B 26/003* (2013.01); *A63B 2225/09* (2013.01); *A63B 2225/093* (2013.01); *A63B 2225/096* (2013.01)

(58) Field of Classification Search

CPC . A63B 23/0211; A63B 2210/50; A63B 41/00; A63B 2225/62; A63B 2023/006; A63B 23/0233; A63B 17/00; A63B 1/00; A63B 21/00047; A63B 21/4029; A63B 2208/0247; A63B 2208/0257; A63B 2071/025; A63B 21/015; A63B 2208/0252; A63B 21/078

USPC ..... 482/142

See application file for complete search history.

(56) References Cited

U.S. PATENT DOCUMENTS 5,833,587 A * 11/1998 Strong ..... A63B 21/154 482/121

6,224,518 B1 5/2001 Weiss et al.

(Continued)

OTHER PUBLICATIONS

International Search Report and Written Opinion for PCT/US2015/025600 dated Jun. 29, 2015.

*Primary Examiner* — Andrew S Lo

(74) *Attorney, Agent, or Firm* — Jiarong L. Lamiquiz; Quarles & Brady LLP

(57) ABSTRACT

A workout bench which includes a first assembly comprising a first vertical member and a second vertical member, wherein a first horizontal member interconnects a first end of the first vertical member to a first end of the second vertical member, and a second horizontal member interconnects a second end of the first vertical member to a second end of the second vertical member. The workout bench further includes a third assembly comprising a third vertical member and a fourth vertical member, wherein a third horizontal member interconnects a first end of the third vertical member to a first end of the fourth vertical member, and a fourth horizontal member interconnects a second end of the third vertical member to a second end of the fourth vertical member. A second assembly comprising a fifth horizontal member interconnects a first end of the second vertical member and a first end of the third vertical member. An upwardly facing, hemispherical cradle is disposed on the fifth horizontal member.

7 Claims, 13 Drawing Sheets

(51) Int. Cl.
*A63B 26/00* (2006.01)
*A63B 21/00* (2006.01)

(56) References Cited

U.S. PATENT DOCUMENTS

| | | | | |
|---|---|---|---|---|
| 6,375,601 | B1 * | 4/2002 | Johnson | A61H 1/0292 297/452.13 |
| 6,461,284 | B1 * | 10/2002 | Francavilla | A61H 1/0218 482/121 |
| 6,478,721 | B1 * | 11/2002 | Hunter | A63B 21/0085 482/140 |
| 6,616,238 | B1 * | 9/2003 | Guery-Strahm | A47C 9/002 297/440.1 |
| 6,746,372 | B2 * | 6/2004 | Hsu | A47C 9/002 482/123 |
| 7,118,517 | B1 * | 10/2006 | Hale | A63B 21/4015 482/140 |
| 7,226,400 | B1 | 6/2007 | Gedeon-Janvier | |
| D727,443 | S * | 4/2015 | Dixon | D21/690 |
| D727,444 | S * | 4/2015 | Dixon | D21/690 |
| 2004/0180768 | A1 * | 9/2004 | Almada | A63B 23/0211 482/142 |
| 2005/0079964 | A1 * | 4/2005 | Francavilla | A63B 23/0233 482/142 |
| 2011/0124476 | A1 | 5/2011 | Holley | |
| 2011/0306480 | A1 | 12/2011 | Beaulieu et al. | |
| 2012/0015787 | A2 | 1/2012 | Crawley et al. | |

* cited by examiner

WORKOUT BENCH

CROSS-REFERENCE TO RELATED APPLICATIONS

This Application is a Non-Provisional Application claiming priority to the U.S. Provisional Application having Ser. No. 61/978,502 filed Apr. 11, 2014, which is hereby incorporated by reference herein.

FIELD OF THE INVENTION

This invention relates to a persons strength training and balance while supported by a body length workout bench.

BACKGROUND OF THE INVENTION

Prior art workout benches provide a user with an elevated support surface on which to position a portion of the body while performing a variety of muscle flexing, muscle stretching, and muscle strengthening exercises. Many workout benches are padded to provide a resilient surface on which to perform such exercises. Because workout benches are elevated above a floor surface, users may perform exercises on the support surface of the workout bench using a wider range of motion than would be possible if the identical exercise were performed on the floor surface.

For example, when people lay on their backs on a floor surface, their outstretched arms may be raised between the horizontal floor surface and a vertical position, allowing a 90 degree range of motion. In contrast, users laying on their backs on the support surface of a workout bench may move their arms between a vertical position and a position below the horizontal plane of the support surface, allowing a range of motion greater than 90 degrees.

However, even though workout benches provide a user with a greater range of motion over that possible when users perform identical exercises on a floor surface, the generally rectangular support surfaces of prior art workout benches and prior art weightlifting benches limit the downward motion of a user's shoulders and arms due to scapular restriction. Also, when the lower portion of a user's upper arms move below the horizontal plane of the workbench support surface during exercise, they engage the lateral edges of the support surface causing the neck and spine of the user to be raised from the support surface. This puts pressure on both the neck and spine of the user as long as the upper arms remain below the horizontal plane of the support surface. The increased pressure on the neck and spine of the user may not only cause discomfort for the user, it may lead to injury.

What is needed is a workout bench that allows a more ergonomic and anatomically correct position which allows for a greater range of motion for the shoulder blades (scapula) and arms of a user during the lifting of free weights, without placing undue stress on ancillary muscles and connective tissues.

SUMMARY OF THE INVENTION

A workout bench is presented, where that work out bench comprises a first assembly comprising a first vertical member having a first end and a second end and a second vertical member having a first end and a second, wherein a first horizontal member interconnects said first end of said first vertical member to said first end of said second vertical member, and a second horizontal member interconnects said second end of said first vertical member to said second end of said second vertical member; a third assembly comprising a third vertical member having a first end and a second end and a fourth vertical member having a first end and a second, wherein a third horizontal member interconnects said first end of said third vertical member to said first end of said fourth vertical member, and a fourth horizontal member interconnects said second end of said third vertical member to said second end of said fourth vertical member.

The workout bench further comprises a second assembly comprising a fifth horizontal member interconnecting said first end of said first vertical member and said first end of said third vertical member, and an upwardly facing, hemispherical cradle disposed on said fifth horizontal member, wherein said upwardly facing, hemispherical cradle is disposed between said second vertical member and said third vertical member.

A workout bench is presented, where that workout bench comprises a first assembly comprising a first vertical member having a first end and a second end and a second vertical member having a first end and a second, wherein a first horizontal member interconnects said first end of said first vertical member to said first end of said second vertical member, and a second horizontal member interconnects said second end of said first vertical member to said second end of said second vertical member.

The workout bench further comprises a third assembly comprising a third vertical member having a first end and a second end and a fourth vertical member having a first end and a second, wherein a third horizontal member interconnects said first end of said third vertical member to said first end of said fourth vertical member, and a fourth horizontal member interconnects said second end of said third vertical member to said second end of said fourth vertical member;

The workout bench further comprises a first transverse member comprising a first mid-point, wherein said first transverse member is attached at said first mid-point to said first vertical member, a second transverse member comprising a second mid-point, wherein said second transverse member is attached at said second mid-point to said second vertical member, and a third transverse member comprising a third mid-point, wherein said third transverse member is attached at said third mid-point to said third vertical member, and a fourth transverse member comprising a fourth mid-point, wherein said fourth transverse member is attached at said fourth mid-point to said fourth vertical member.

The workout bench further comprises a second assembly comprising a fifth horizontal member interconnecting said second transverse member and said third transverse member; and a sixth horizontal member interconnecting said second transverse member and said third transverse member.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF PREFERRED EMBODIMENTS

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
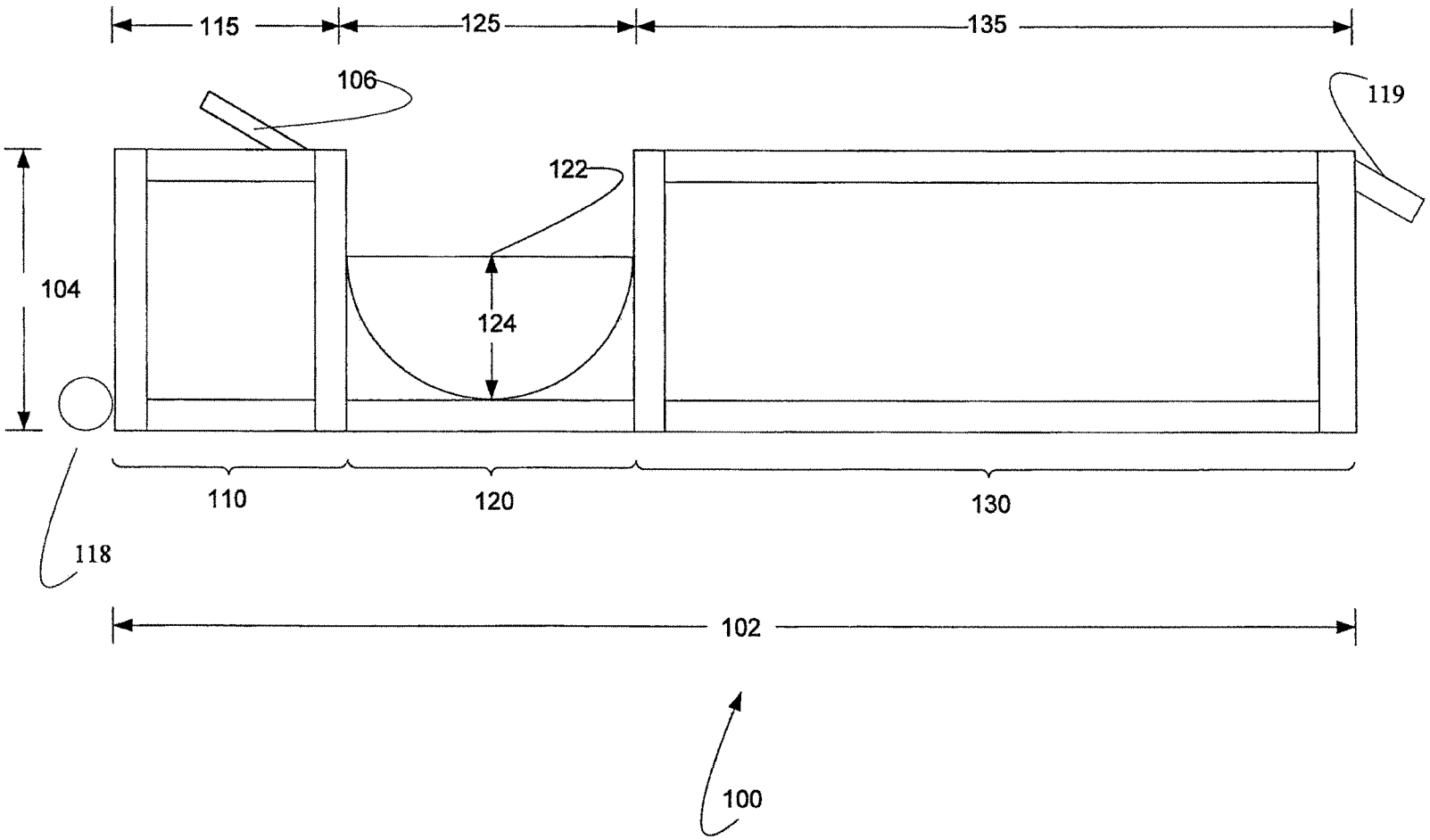
FIG. 1A illustrates a side view of a first embodiment of Applicant's workout bench.

Referring now to FIG. 1A, workout bench frame 100 comprises an overall length 102 and a height 104. In certain embodiments, length 102 is between about 45 inches and about 70 inches. In certain embodiments, length 102 is about 56 inches.

In certain embodiments, height 104 is between about 15 inches and about 35 inches. In certain embodiments, height 104 is about 18 inches.

Applicant's workout bench frame 100 comprises three sub-assemblies, namely assemblies 110, 120, and 130. In certain embodiments, assembly 110 comprises a length 115 and height 104. In certain embodiments, length 115 is between about 10 inches and about 18 inches. In certain embodiments, length 115 is about 13 inches.

Assembly 110 includes a pair of upwardly extending handles. FIG. 1A illustrates handle 106. In certain embodiments, assembly 110 further comprises one or more wheels 118.

In certain embodiments, assembly 120 comprises a length 125 and height 104. In certain embodiments, length 125 is between about 15 inches and about 30 inches. In certain embodiments, length 125 is about 22 inches.

Assembly 120 comprises an upwardly facing, hemispherical cradle 122, having an interior space with a depth 124. In certain embodiments, depth 124 is between about 5 inches to about 10 inches. In certain embodiments, depth 124 is about 7 inches.

In certain embodiments, upwardly facing, hemispherical cradle 122 is formed from one or more metals. In certain embodiments, upwardly facing, hemispherical cradle 122 is formed from wood. In certain embodiments, upwardly facing, hemispherical cradle 122 is formed from one or more molded plastics.

In certain embodiments, assembly 130 comprises a length 135 and height 104. In certain embodiments, length 135 is between about 20 inches and about 30 inches. In certain embodiments, length 115 is about 23 inches.

Figure 1B:
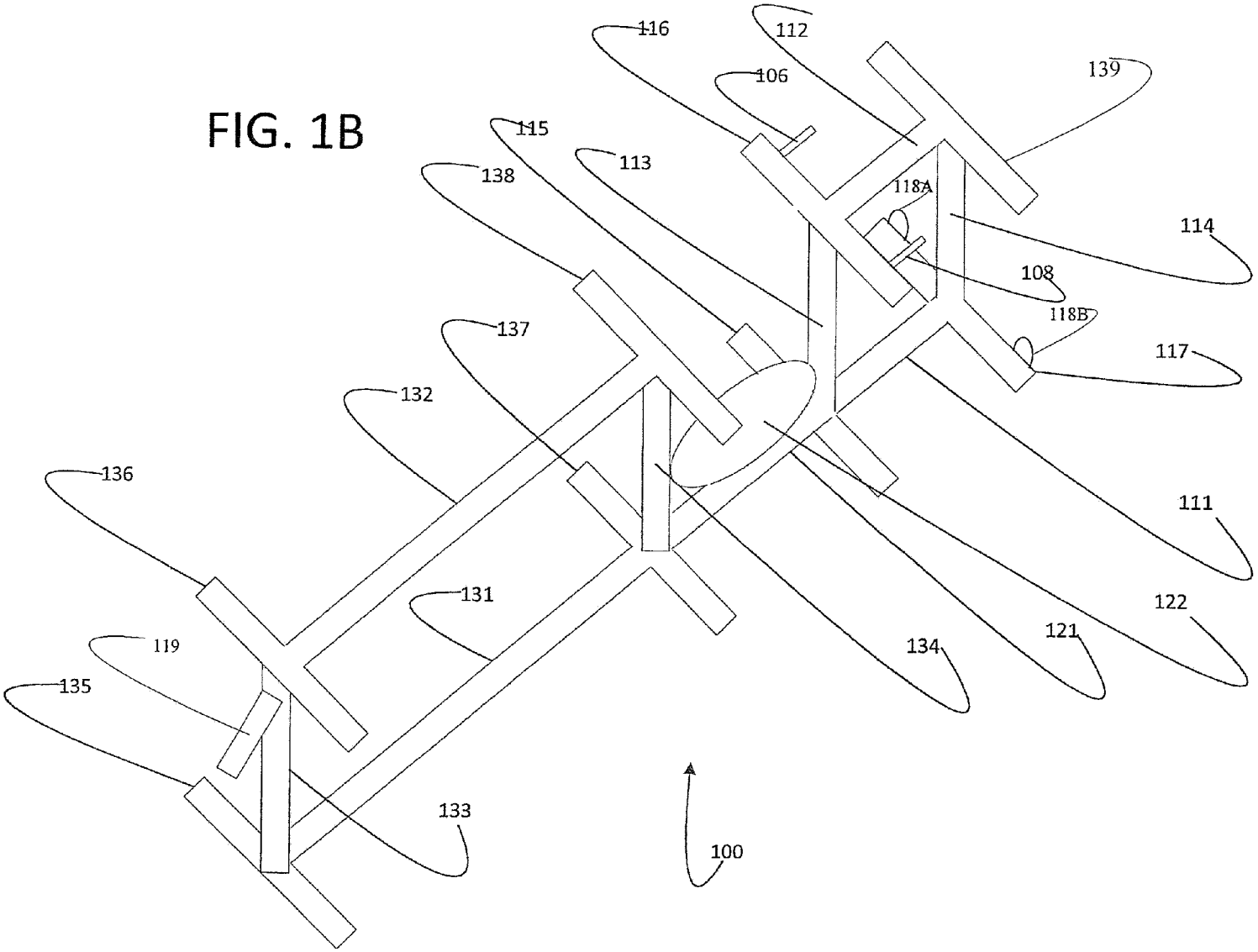
FIG. 1B is a perspective view of a workout bench frame of FIG. 1A.

Referring to FIG. 1B, workout bench frame 100 comprises a horizontal member 131. In certain embodiments, horizontal member 131 comprises a square cross-section. In certain embodiments, horizontal member 131 comprises a circular cross-section. In certain embodiments, horizontal member 131 comprises a triangular cross-section.

In certain embodiments, horizontal member 131 is formed from one or more metals. In certain embodiments, horizontal member 131 is formed from wood. In certain embodiments, horizontal member 131 is formed from one or more molded plastics.

Transverse members 135, 137, 115, and 117, are attached to, and extend outwardly from, horizontal member 131. In certain embodiments, wheels 118A and 118B are rotationally mounted on transverse member 117.

In certain embodiments, transverse members 135, 137, 115, and 117, comprise a square cross-section. In certain embodiments, In certain embodiments, transverse members 135, 137, 115, and 117, comprise a circular cross-section. In certain embodiments, in certain embodiments, transverse members 135, 137, 115, and 117, comprise a triangular cross-section.

In certain embodiments, transverse members 135, 137, 115, and 117, are formed from one or more metals. In certain embodiments, transverse members 135, 137, 115, and 117, are formed from wood. In certain embodiments, transverse members 135, 137, 115, and 117, are formed from one or more molded plastics. In certain embodiments, horizontal member 131 in combination with horizontal members 135, 137, 115, and 117, comprises an integral structure.

Workout bench frame 100 further comprises vertical members 133, 134, 113, 113B, 113C, and 114. In certain embodiments, handle 119 is attached to, and extends outwardly from, vertical member 133.

In certain embodiments, vertical members 133, 134, 113, and 114, comprise a square cross-section. In certain embodiments, vertical members 133, 134, 113, and 114, comprise a circular cross-section. In certain embodiments, vertical members 133, 134, 113A, 113B, 113C, and 114, comprise a triangular cross-section.

In certain embodiments, vertical members 133, 134, 113, and/or 114, are formed from one or more metals. In certain embodiments, vertical members 133, 134, 113, and 114, are formed from wood. In certain embodiments, vertical members 133, 134, 113 114, are formed from one or more molded plastics.

A first end of vertical member 133, 134, 113, and 114, is attached to horizontal member 131, using conventional attachment means such as welding, adhesive bonding, and the like. In certain embodiments, horizontal member 131 in combination with vertical members 133, 134, 113, and 114, comprises an integral structure.

Horizontal member 132 interconnects atop end of vertical members 133 and 134. In certain embodiments, horizontal member 132 comprises a square cross-section. In certain embodiments, horizontal member 132 comprises a circular cross-section. In certain embodiments, horizontal member 132 comprises a triangular cross-section.

In certain embodiments, horizontal member 132 is formed from one or more metals. In certain embodiments, horizontal member 132 is formed from wood. In certain embodiments, horizontal member 132 is formed from one or more molded plastics.

Transverse members 136 and 138 each comprise a mid-point and are attached at those mid-points to, and extend outwardly from, horizontal member 132. In certain embodiments, transverse members 136 and 138 comprise a square cross-section. In certain embodiments, transverse members 136 and 138 comprise a circular cross-section. In certain embodiments, transverse members 136 and 138 comprise a triangular cross-section.

In certain embodiments, transverse members 136 and 138, are formed from one or more metals. In certain embodiments, transverse members 136 and 138, are formed from wood. In certain embodiments, transverse members 136 and 138 are formed from one or more molded plastics. In certain embodiments, horizontal member 132 in combination with transverse members 136 and 138 comprises an integral structure.

Horizontal member 112 interconnects a top end of vertical members 113 and 114. In certain embodiments, horizontal member 112 comprises a square cross-section. In certain embodiments, horizontal member 112 comprises a circular cross-section. In certain embodiments, horizontal member 112 comprises a triangular cross-section In certain embodiments, horizontal member 112 is formed from one or more metals. In certain embodiments, horizontal member 112 is formed from wood. In certain embodiments, horizontal member 112 is formed from one or more molded plastics.

Transverse member 116 comprises amid-point and is attached at the mid-point to, and extends outwardly from, a first end of horizontal member 112. In certain embodiments, transverse member 116 comprises a square cross-section. In certain embodiments, transverse member 116 comprises a circular cross-section. In certain embodiments, transverse member 116 comprises a triangular cross-section.

In certain embodiments, transverse member 116 is formed from one or more metals. In certain embodiments, transverse member 116 is from wood. In certain embodiments, transverse member 116 is formed from one or more molded plastics. In certain embodiments, horizontal member 112 in combination with transverse member 116 comprises an integral structure.

Transverse member 139 comprises amid-point and is attached at the mid-point to, and extends outwardly from, a second end of horizontal member 112. In certain embodiments, transverse member 116 comprises a square cross-section. In certain embodiments, transverse member 116 comprises a circular cross-section. In certain embodiments, transverse member 116 comprises a triangular cross-section.

In certain embodiments, transverse member 116 is formed from one or more metals. In certain embodiments, transverse member 116 is from wood. In certain embodiments, transverse member 116 is formed from one or more molded plastics. In certain embodiments, horizontal member 112 in combination with transverse member 116 comprises an integral structure.

Handle 106 is attached to, and extends upwardly and backwardly from, transverse member 116. Handle 108 is attached to, and extends upwardly and backwardly from, transverse member 116. In certain embodiments, handles 106 and 108 are about 8 inches in length, and comprise a cylindrical member having a diameter of about 1 inch.

Upwardly facing, hemispherical cradle 122 is attached to horizontal member 131, and is disposed between vertical members 134 and 113.

Figure 1C:
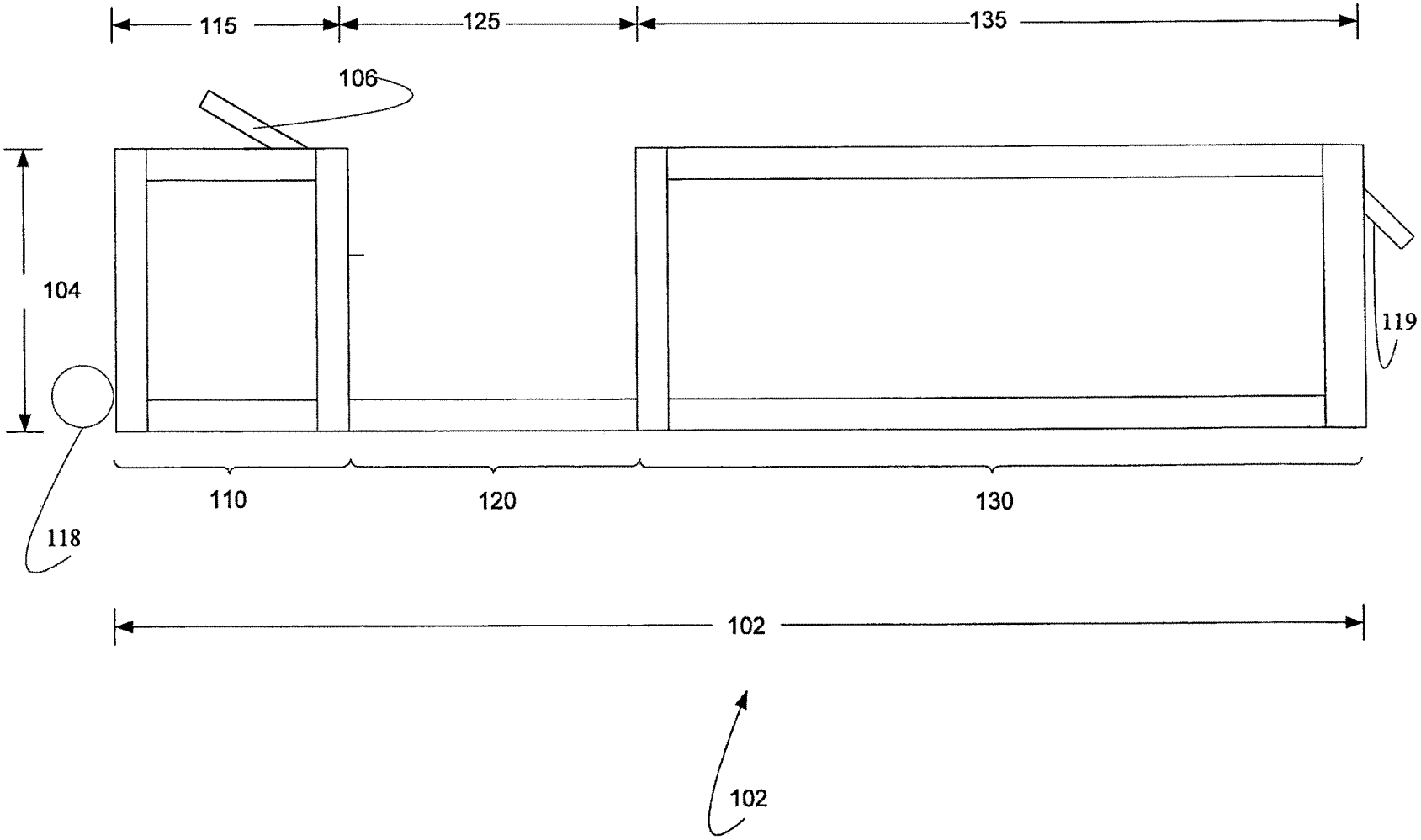
FIG. 1C is a side view of a second embodiment of Applicant's workout bench.
Figure 1D:
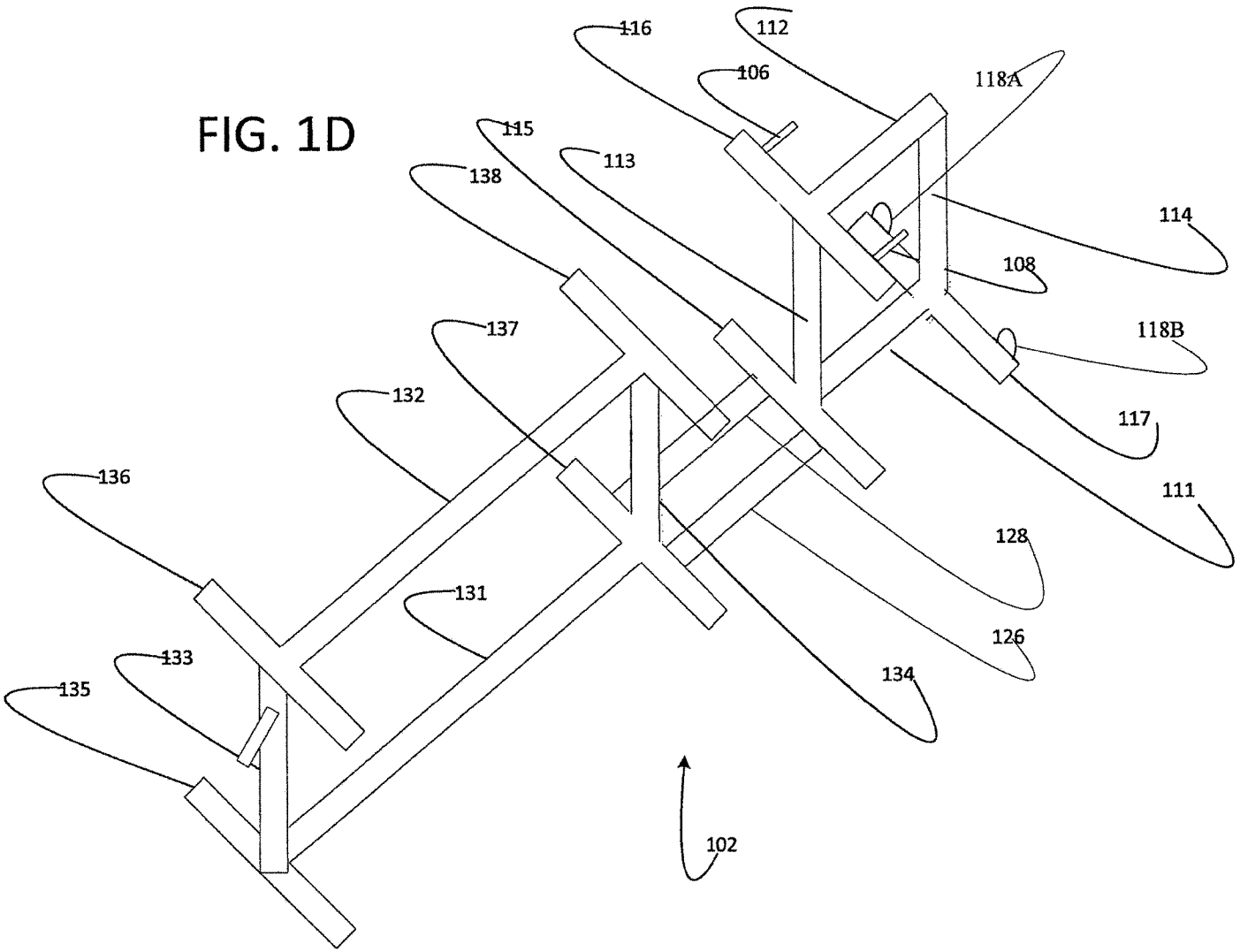
FIG. 1D is a perspective view of a workout bench frame of FIG. 1C.

Referring now to FIGS. 1C and 1D, Applicant's workout bench frame 102 comprises the elements of frame 100 with the exception of cradle 122. As shown in FIG. 1C, assembly 120 does not include an upwardly facing, hemi-spherical cradle 122. Rather, as shown in FIG. 1D, assembly 120 comprises a pair of parallel, horizontal members 126 and 128. Horizontal members 126 and 128 attached to transverse members 137 and 115.

Figure 2:
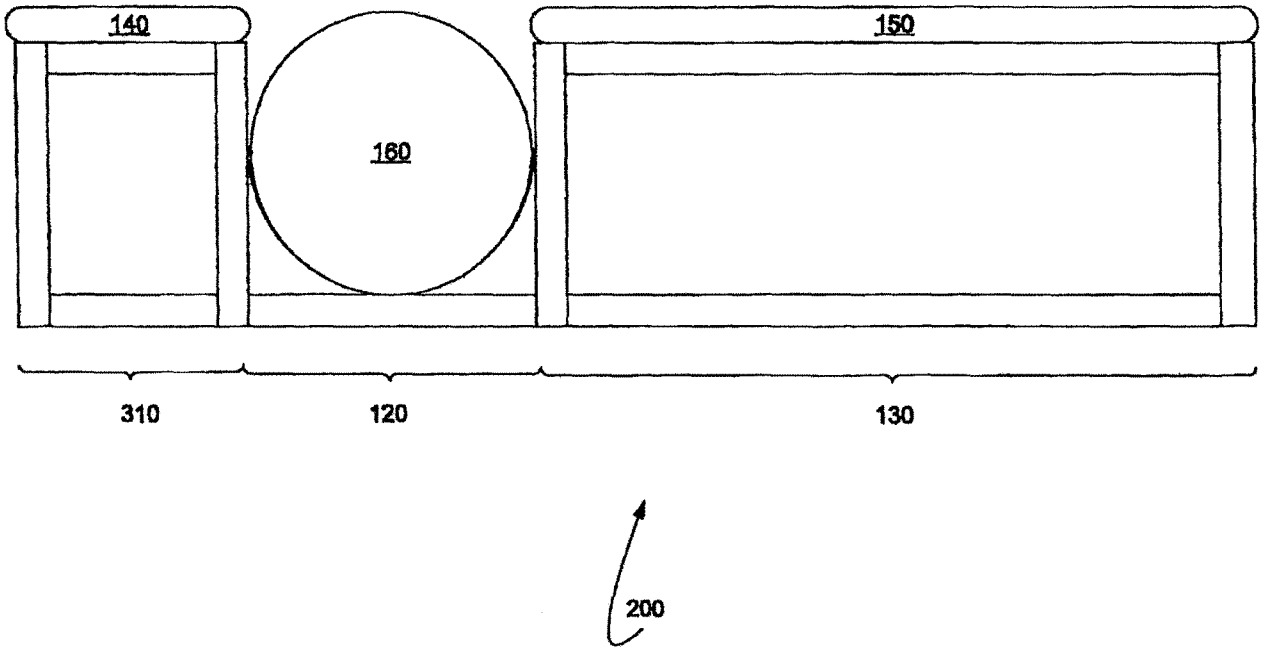
FIG. 2 illustrates a second embodiment of Applicant's workout bench.

Referring now to FIG. 2, workout bench 200 includes the elements of workout bench frame 100/102 in combination with assembly 140 disposed on transverse members 112 and 116, assembly 150 disposed between transverse members 136 and 138, and sphere 160. When using frame 100, sphere 160 is removeably disposed in cradle 122. When using frame 200, sphere 160 is removeably disposed between horizontal members 126 and 128. In certain embodiments, a top portion of sphere 160 extends above a horizontal plane defined by the top surfaces of assemblies 140 and 150.

In certain embodiments assembly 140 comprises a foam pad in combination with a planar support member. In certain embodiments, the foam pad comprises a high resilient foam. In certain embodiments, assembly 140 is between about 0.5 inches and about 3 inches thick.

In certain embodiments assembly 150 comprises a foam pad in combination with a planar support member. In certain embodiments, the foam pad comprises a high resilient foam. In certain embodiments, assembly 150 is between about 0.5 inches and about 3 inches thick.

In certain embodiments, sphere 160 comprises a contiguous polymeric shell filled with air. In certain embodiments, the polymeric shell is formed from polyethylene. In certain embodiments, the polymeric shell is formed from polypropylene. In certain embodiments, the polymeric shell is formed from latex rubber. In certain embodiments, the polymeric shell is formed from an elastomeric polyurethane.

In certain embodiments, the air pressure within sphere 160 can be adjusted to vary the diameter and the overall hardness. In certain embodiments, the diameter of sphere 160 can be adjusted from about 15 inches to about 30 inches.

Figure 3A:
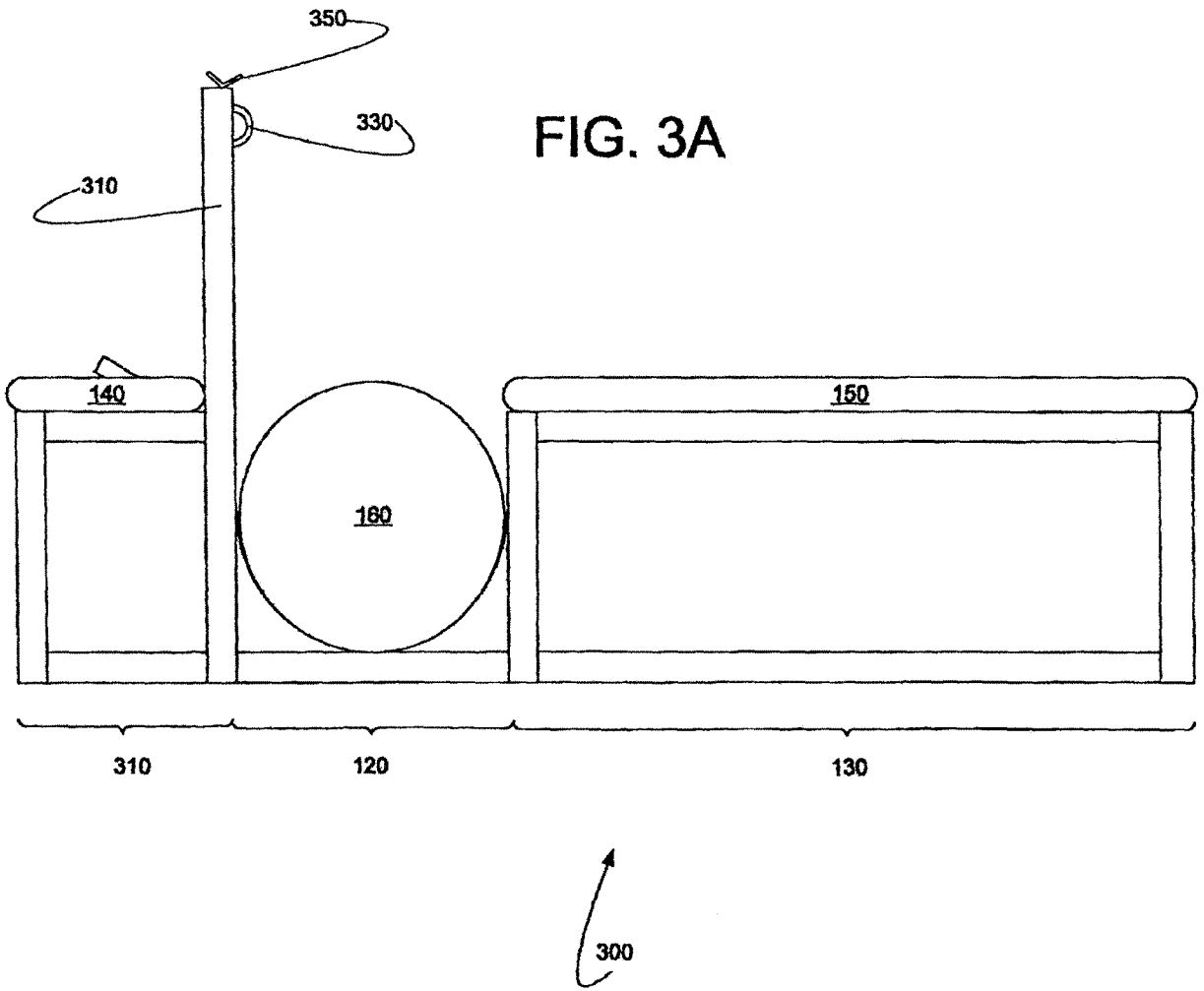
FIG. 3A illustrates a side view of a third embodiment of Applicant's workout bench.
Figure 3B:
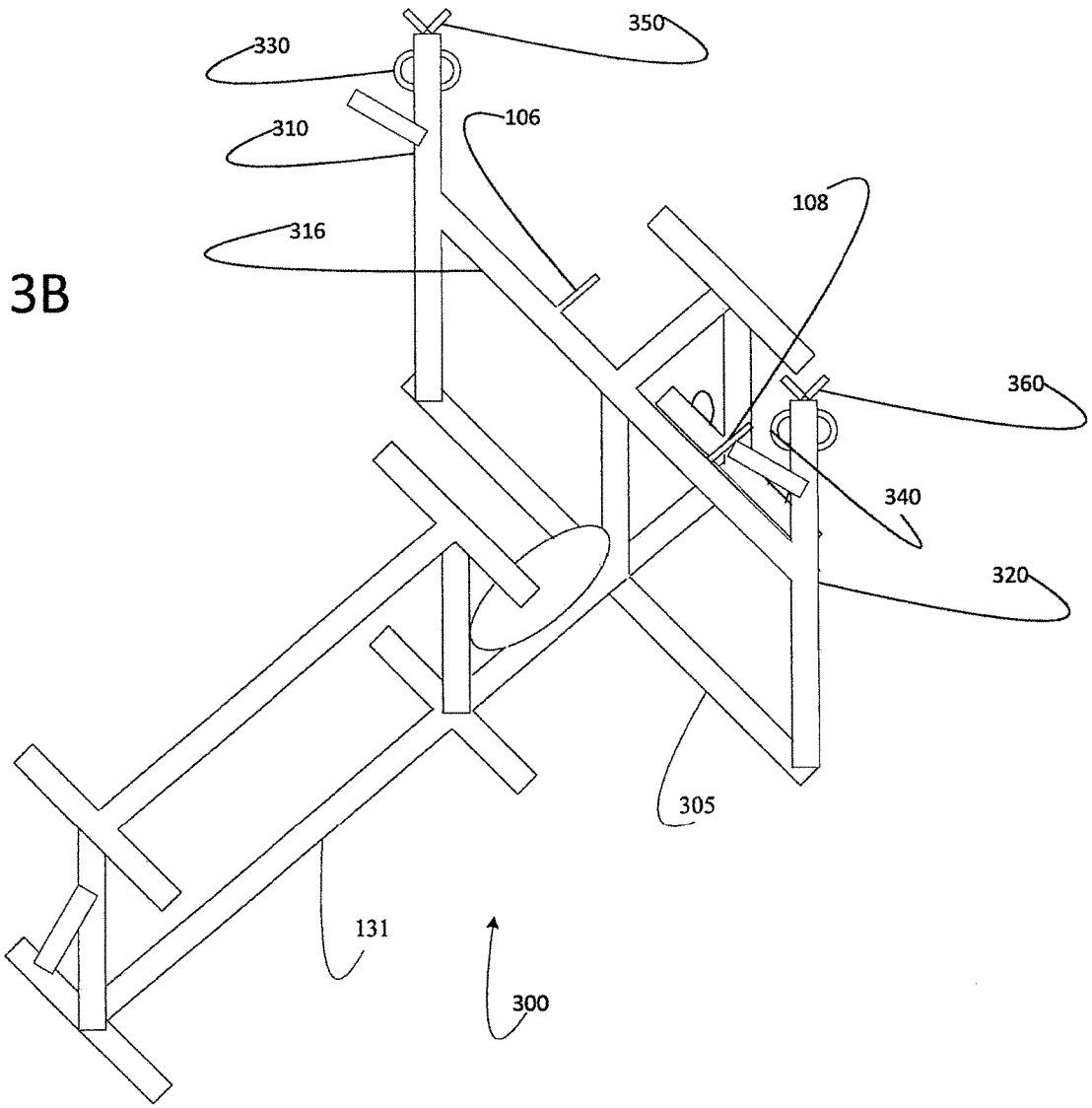
FIG. 3B is a perspective view of a workout bench frame of FIG. 3A.

Referring now to FIGS. 3A and 3B, Applicant's workout bench 300 comprises transverse member 305 attached to an extending outwardly from horizontal member 131. In certain embodiments, transverse member 305 comprises a square cross-section. In certain embodiments, transverse member 305 comprises a circular cross-section. In certain embodiments, transverse member 305 comprises a triangular cross-section. In certain embodiments, frame 300 includes wheels 118A and 118B. In certain embodiments, frame 300 includes handle 119.

In certain embodiments, transverse member 305 is formed from one or more metals. In certain embodiments, transverse member 305 is formed from wood. In certain embodiments, transverse member 305 is formed from one or more molded plastics.

In certain embodiments, transverse member 305 has a length between about 35 inches and about 50 inches. In certain embodiments, transverse member 305 has a length of about 40 inches. In certain embodiments, horizontal member 131 in combination with transverse member 305 comprises an integral structure.

Vertical members 310 and 320 are attached to and extend upwardly from the two opposing ends of transverse members 305 and 316. Vertical members 310 and 320 are attached to transverse member 316. In certain embodiments, transverse member 316 comprises a square cross-section. In certain embodiments, transverse member 316 comprises a circular cross-section. In certain embodiments, transverse member 316 comprises a triangular cross-section.

In certain embodiments, transverse member 316 is formed from one or more metals. In certain embodiments, transverse member 316 is formed from wood. In certain embodiments, transverse member 316 is formed from one or more molded plastics.

In certain embodiments, transverse member 316 has a length between about 35 inches and about 45 inches. In certain embodiments, transverse member 316 has a length of about 46 inches.

In certain embodiments, vertical members 310 and 320 comprise a square cross-section. In certain embodiments, vertical members 310 and 320 comprise a circular cross-section. In certain embodiments, vertical members 310 and 320 comprise a triangular cross-section.

In certain embodiments, vertical members 310 and 320 have a height between about 30 inches and about 40 inches. In certain embodiments, vertical members 310 and 320 have a height of about 32 inches. In certain embodiments, the heights of vertical members 310 and 320 are adjustable.

In certain embodiments, vertical members 310 and 320 are formed from one or more metals. In certain embodiments, vertical members 310 and 320 are formed from wood. In certain embodiments, vertical members 310 and 320 are formed from one or more molded plastics.

In certain embodiments, workout bench 300 includes tie positions 330 and 340. In certain elastomeric straps can be releasably attached to tie positions 330 and 340. In certain embodiments, workout bench further comprises bar rests 350 and 360 disposed on the top portion for holding free weights during bench press lifting.

Figure 3C:
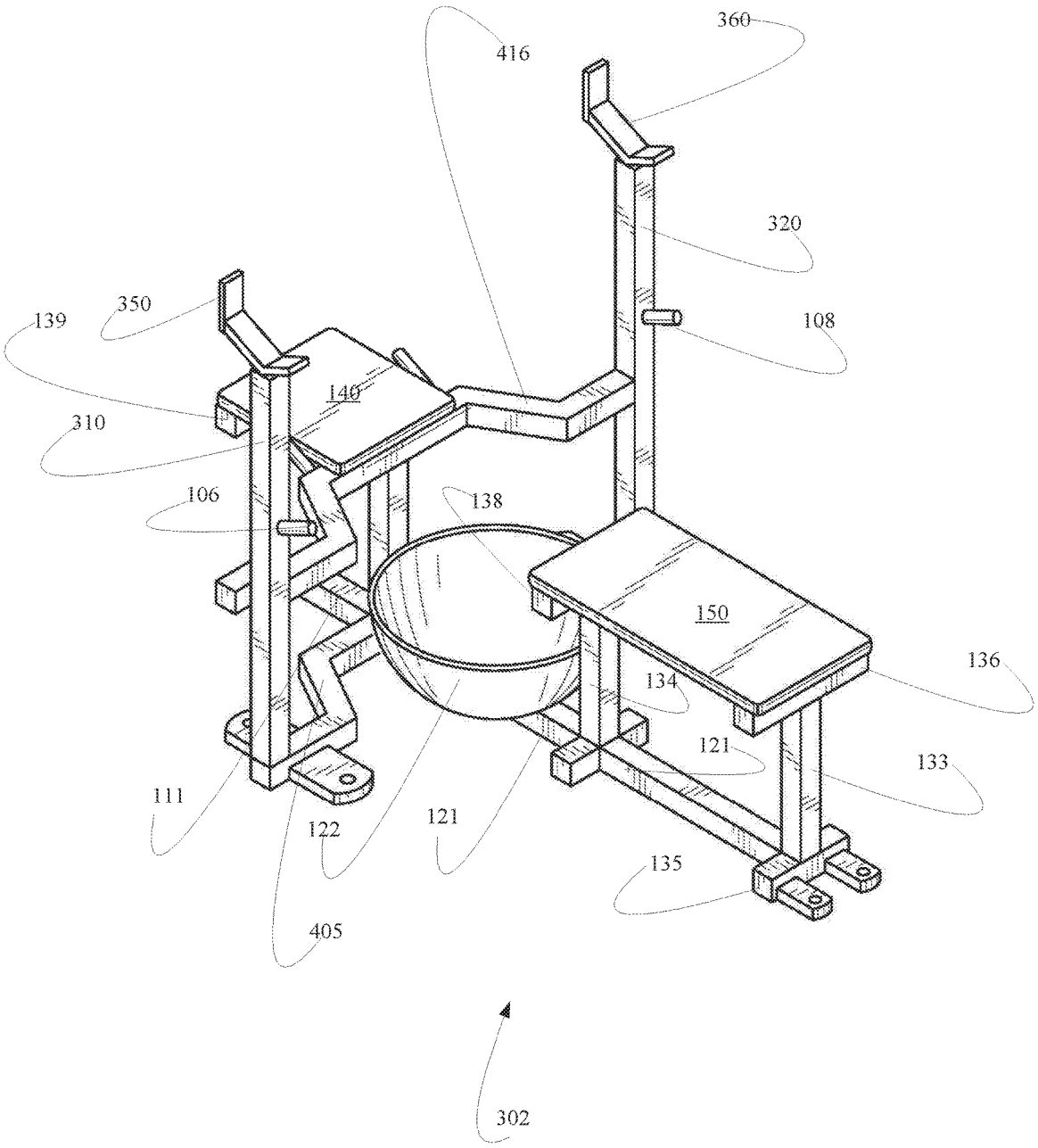
FIG. 3C illustrates fourth embodiment of Applicant's workout bench.

Referring now to FIG. 3C, workout bench 302 comprises the elements of workout bench 300 wherein straight transverse member 305 is replaced by serpentine transverse member 405, and wherein straight transverse member 316 is replaced by serpentine transverse member 416.

Figure 3D:
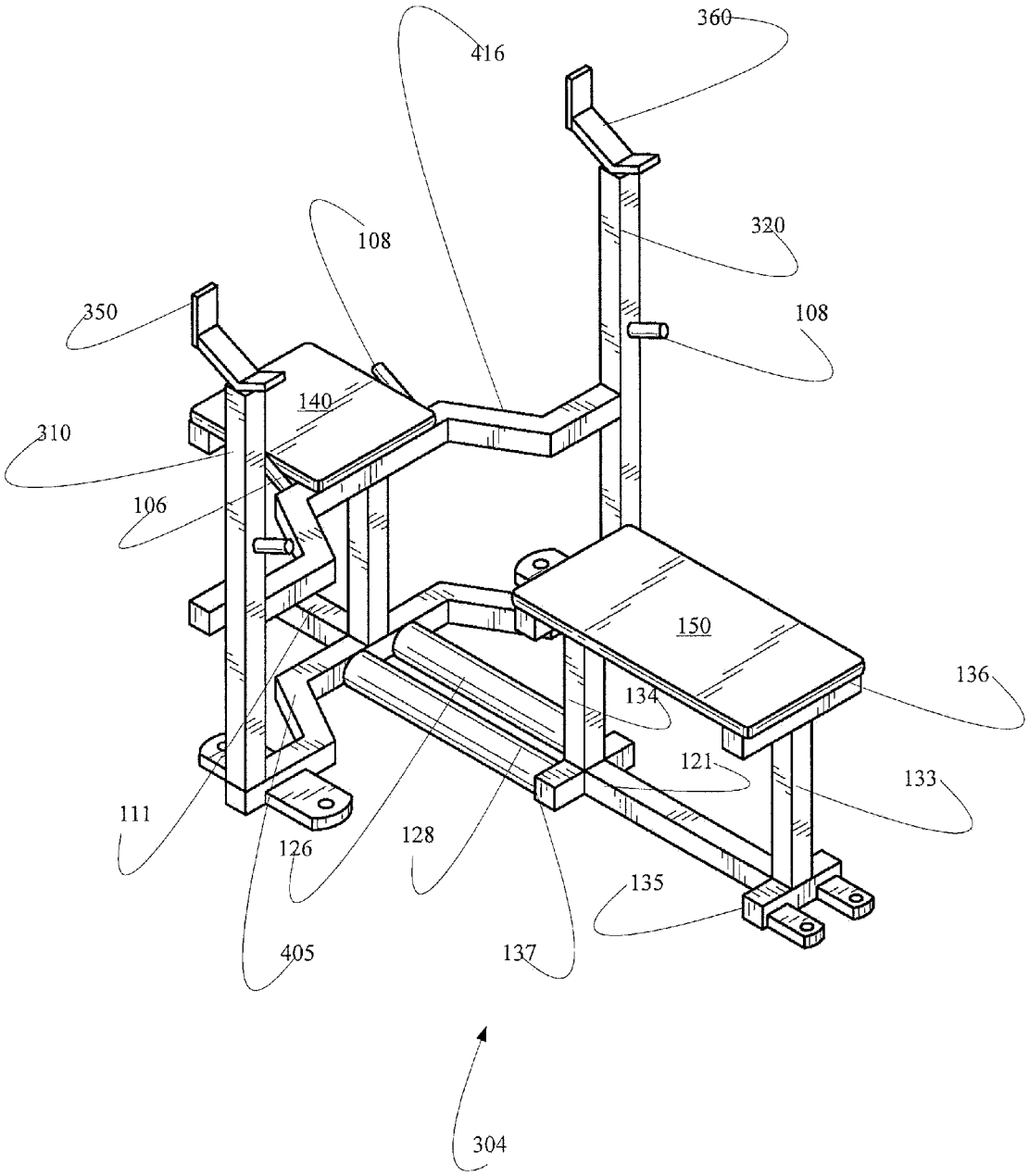
FIG. 3D illustrates a fourth embodiment of Applicant's workout bench.

Referring now to FIG. 3D, workout bench 304 comprises the elements of workout bench 402, wherein workout bench 304 does not comprise a cradle 122, and wherein horizontal member 121 is replaced by a set of horizontal members 126 and 128, wherein horizontal members 126 and 128 comprise a circular cross-section. Workout bench 304 further comprises serpentine transverse members 405 and 416.

Figure 4A:
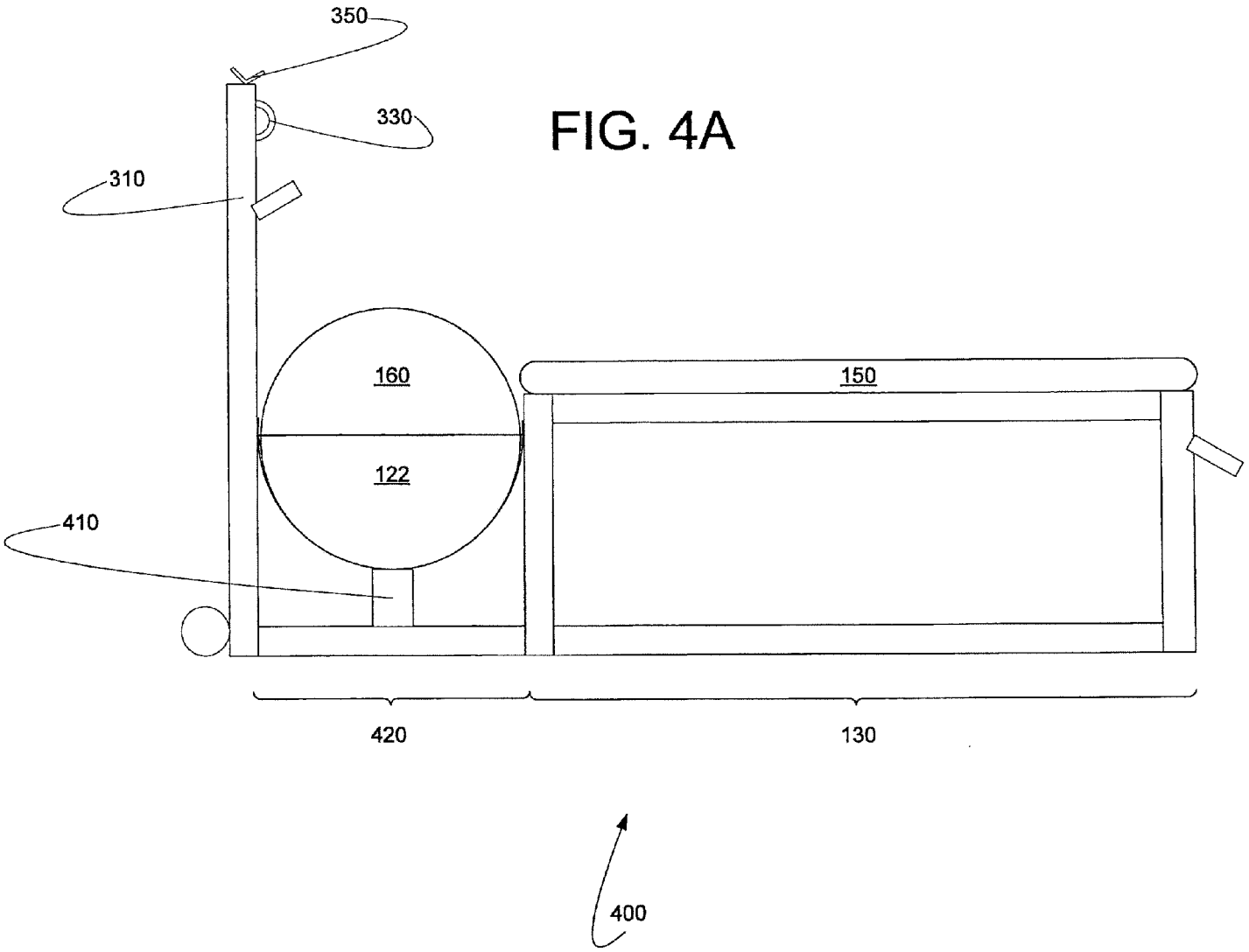
FIG. 4A illustrates a side view of a fifth embodiment of Applicant's workout bench.
Figure 4B:
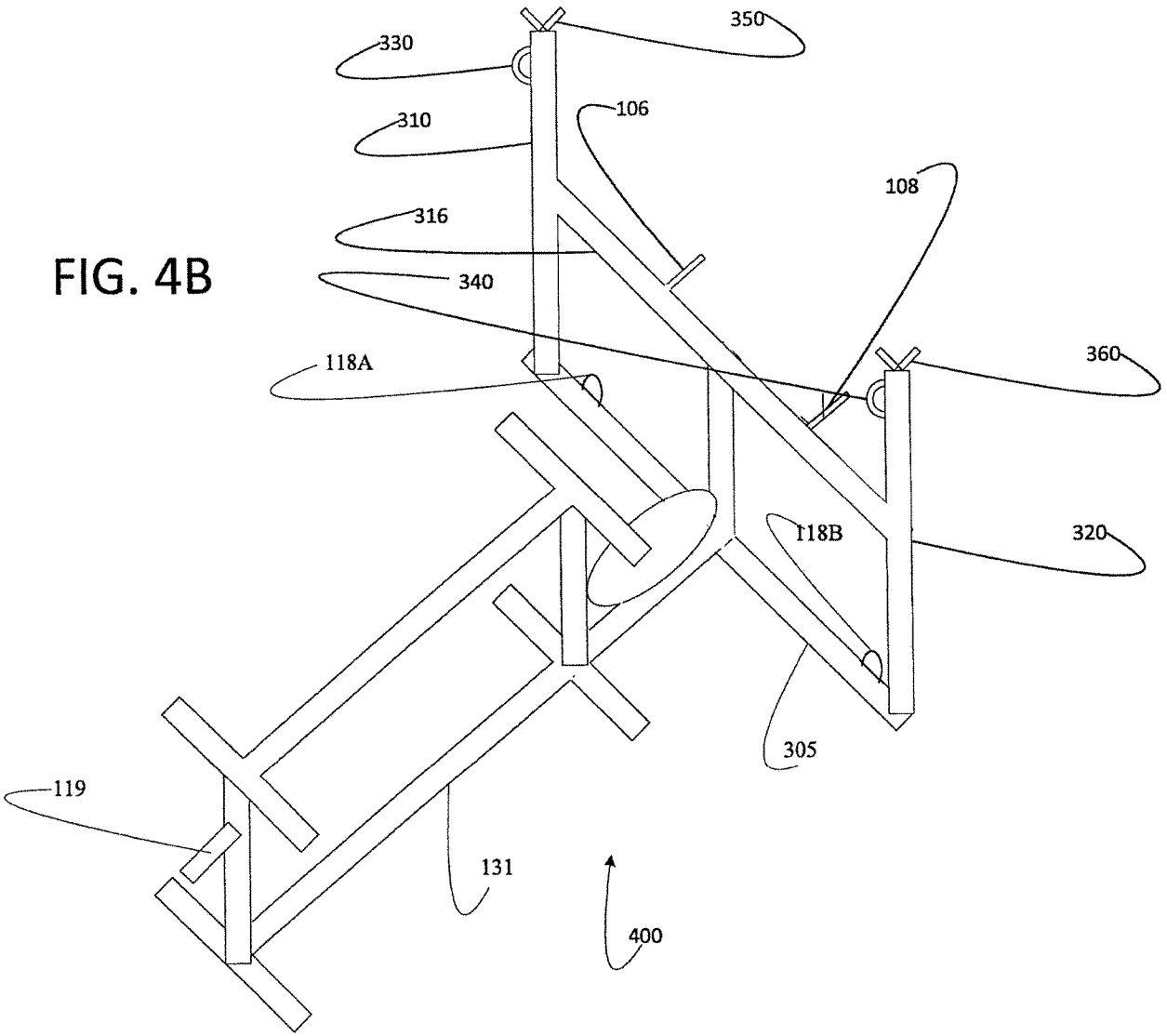
FIG. 4B is a perspective view of the workout bench frame of FIG. 4A.

Referring now to FIGS. 4A and 4B, Applicant's workout bench comprising workout bench frame 400 (FIG. 4B), does not include an assembly 110. Rather, workout bench frame 400 comprises an assembly 420 and an assembly 130. Assembly 420 comprises transverse members 305 and 316 in combination with vertical members 310 and 320.

In certain embodiments, frame 400 includes wheels 118A and 118B. In certain embodiments, frame 400 includes handle 119.

Applicant's workout bench 410 (FIG. 4A), comprising workout bench frame 400 (FIG. 4B), includes vertical adjustment device 410, wherein vertical adjustment device can be use to raise/lower cradle 122 and sphere 160. In certain embodiments, adjustment device 410 comprises a mechanical assembly, wherein an internal shaft can be positioned relative to an external tubular member, and a retaining pin is then inserted through both the tubular member and the internal shaft. In certain embodiments, adjustment device 410 comprises an electric motor which can raise or lower the internal shaft with respect to the external tubular member. In certain embodiments, adjustment device 410 comprise a pneumatic device operable to raise or lower cradle 122.

Figure 5A:
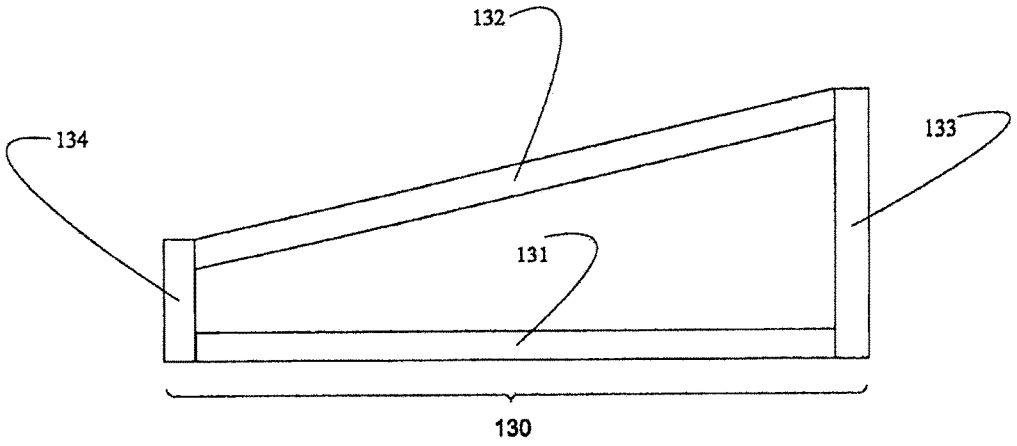
FIG. 5A is a first side view of a variable sloping embodiment of assembly 130 of Applicant's workout bench.

FIG. 5A shows an embodiment of assembly 130 wherein top portion 132 slopes downwardly from vertical member 133 to vertical member 134. In certain embodiments, the length of vertical member 134 is variable. In certain embodiments, the length of vertical member 133 is variable.

Figure 5B:
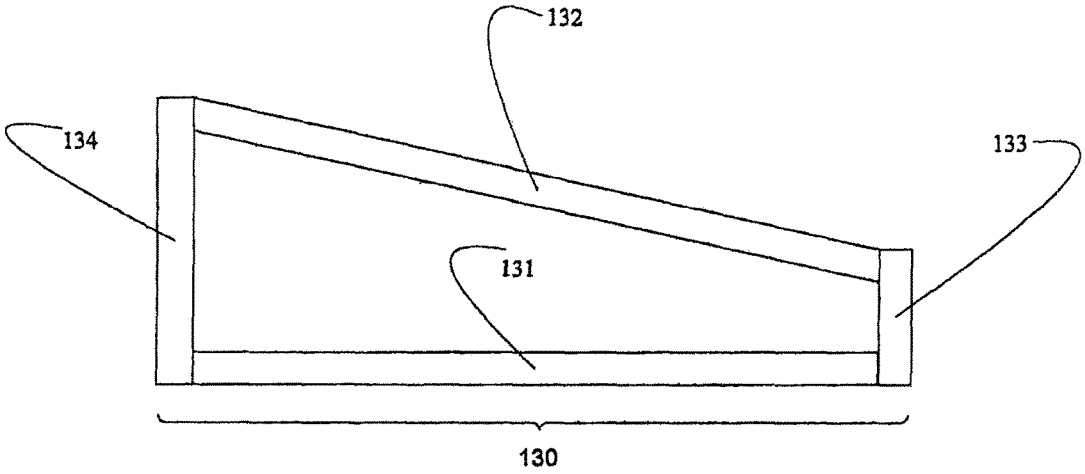
FIG. 5B is a second side view of the variable sloping embodiment of assembly 130 of Applicant's workout bench.

FIG. 5B shows an embodiment of assembly 130 wherein top portion 132 slopes upwardly from vertical member 133 to vertical member 134. In certain embodiments, the length of vertical member 134 is variable. In certain embodiments, the length of vertical member 133 is variable.

The variably-sloping embodiments of assembly 130 illustrated in FIGS. 5A and 5B can be utilized in the workout bench 100 (FIGS. 1A, 1B), and/or in the workout bench 102 (FIGS. 1C, 1D), and/or in the workout bench 200 (FIG. 2), and/or in the workout bench 300 (FIGS. 3A, 3B), and/or in the workout bench 400 (FIGS. 4A, 4B).

While the preferred embodiments of the present invention have been illustrated in detail, it should be apparent that modifications and adaptations to those embodiments may occur to one skilled in the art without departing from the scope of the present invention as set forth herein in the following claims.

I claim:

1. A workout bench, comprising:

a first assembly comprising a first vertical member having a first end and a second end and a second vertical member having a first end and a second, wherein a first horizontal member interconnects said first end of said first vertical member to said first end of said second vertical member, and a second horizontal member interconnects said second end of said first vertical member to said second end of said second vertical member;

a third assembly comprising a third vertical member having a first end and a second end and a fourth vertical member having a first end and a second, wherein a third horizontal member interconnects said first end of said third vertical member to said first end of said fourth vertical member, and a fourth horizontal member interconnects said second end of said third vertical member to said second end of said fourth vertical member;

a second assembly comprising a fifth horizontal member interconnecting said first end of said second vertical member and said first end of said third vertical member;

an upwardly facing, hemispherical cradle disposed on said fifth horizontal member, wherein said upwardly facing, hemispherical cradle is disposed between said second vertical member and said third vertical member;

wherein said upwardly facing, hemispherical cradle is in physical contact with both said second vertical member and said third vertical member;

a vertical adjustment device;

wherein said vertical adjustment device is disposed between said fifth horizontal member and said upwardly facing, hemispherical cradle;

a first transverse member comprising a first mid-point, wherein said first transverse member is attached at said first mid-point to said first vertical member;

a second transverse member comprising a second mid-point, wherein said second transverse member is attached at said second mid-point to said second vertical member;

a third transverse member comprising a third mid-point, wherein said third transverse member is attached at said third mid-point to said third vertical member;

a fourth transverse member comprising a fourth mid-point, wherein said fourth transverse member is attached at said fourth mid-point to said fourth vertical member.

2. The workout bench of claim 1, further comprising:

a fifth transverse member comprising a fifth mid-point, a first end, and a second end;

wherein:

said second vertical member comprises a first end and a second end;

said fifth transverse member is attached at said fifth mid-point to said first end of said second vertical member;

said second transverse member further comprises a first end and a second end;

said second transverse member is attached at said second mid-point to said second end of said second vertical member.

3. The workout bench of claim 2, wherein:

said second transverse member comprises a serpentine shape; and said fifth transverse member comprises a serpentine shape.

4. The workout bench of claim 1, further comprising a first pad disposed between said first transverse member and said second transverse member.

5. The workout bench of claim 4, further comprising a second pad disposed between said third transverse member and said fourth transverse member.

6. The workout bench of claim 5, further comprising a sphere comprising a contiguous polymeric shell removeably disposed within said cradle.

7. The workout bench of claim 6, wherein:

said first pad comprises a first top surface;

said second pad comprises a second top surface;

said first top surface and said second top surface define a horizontal plane;

a top portion of said sphere extends above said horizontal plane.

* * * * *